United States Patent [19]

Kurtz et al.

[11] 4,204,920

[45] May 27, 1980

[54] ELECTROLYTIC PRODUCTION OF CHLORINE AND CAUSTIC SODA

[75] Inventors: Bruce E. Kurtz, Marcellus; Robert H. Fitch, Syracuse, both of N.Y.

[73] Assignee: Allied Chemical Corporation, Morris Township, Morris County, N.J.

[21] Appl. No.: 966,923

[22] Filed: Dec. 6, 1978

[51] Int. Cl.[2] ..... C25B 1/16; C25B 1/26

[52] U.S. Cl. ..... 204/98; 204/128

[58] Field of Search ..... 204/98, 128

[56] References Cited

U.S. PATENT DOCUMENTS

| | | | |
|---|---|---|---|
| 3,242,059 | 3/1966 | Cottam et al. | 204/98 |
| 3,804,739 | 4/1974 | Bergeron | 204/257 |
| 4,036,714 | 2/1977 | Spitzer | 204/98 |
| 4,105,514 | 8/1978 | Justice et al. | 204/98 |

*Primary Examiner*—R. L. Andrews

*Attorney, Agent, or Firm*—Michael S. Jarosz; Jay P. Friedenson

[57] ABSTRACT

A process is disclosed for producing chlorine and caustic soda in an electrolytic membrane cell which comprises providing a pressure differential between the anode compartment and the cathode compartment sufficient to prevent substantial contact of the membrane with the anode, and reducing fluctuations in the pressure differential by allowing depleted sodium chloride brine and chlorine gas to flow freely from the anode compartment to a brine collection point. Also, the caustic soda and hydrogen gas produced in the cathode compartment are allowed to flow freely from the cathode compartment to a caustic soda collection point.

4 Claims, 1 Drawing Figure

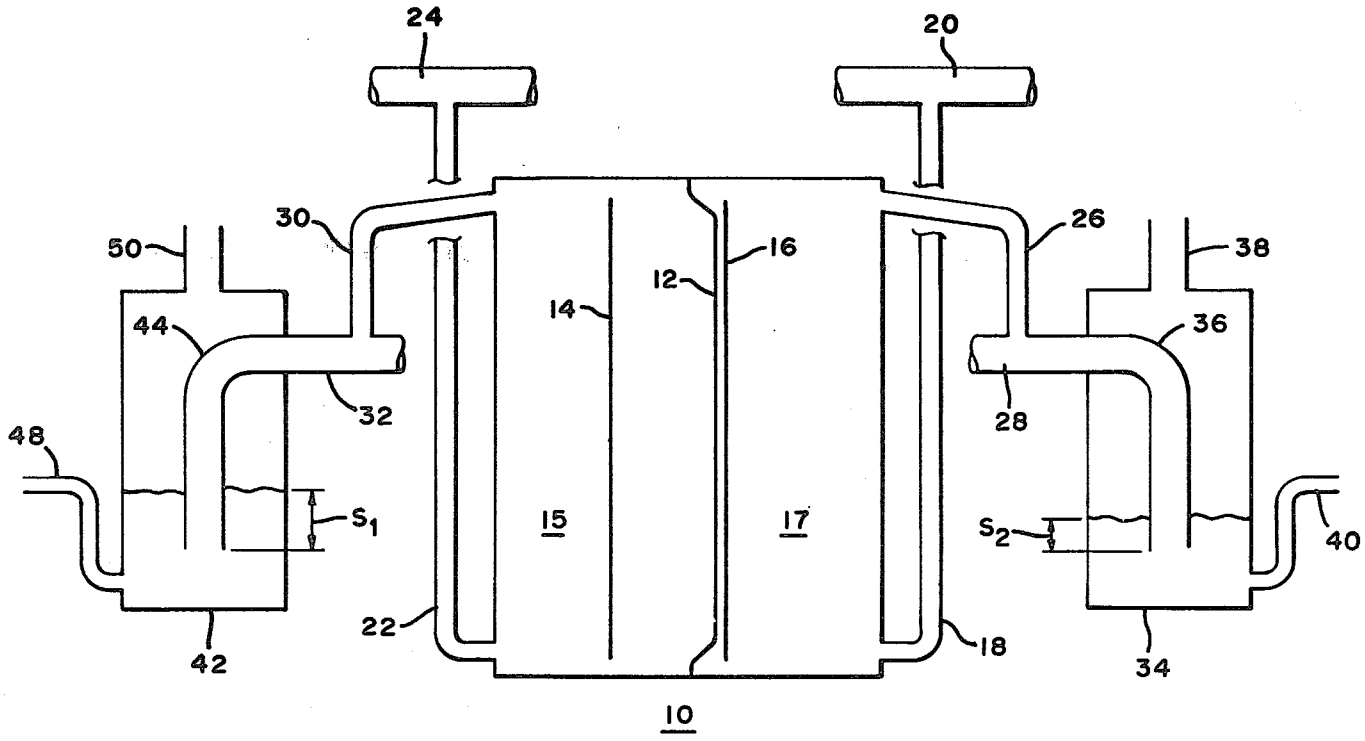
10
12
14
15
16
17
18
20
22
24
26
28
30
32
34
36
38
40
42
44
48
50
$S_1$
$S_2$

ELECTROLYTIC PRODUCTION OF CHLORINE AND CAUSTIC SODA

BACKGROUND OF THE INVENTION

This invention relates to the production of chlorine and sodium hydroxide (caustic soda) from sodium chloride brine employing an electrolytic permselective membrane cell. More particularly, this invention relates to an improved method of opertion of a permselective membrane cell.

As is known in the prior art, a permselective membrane cell consists of three basic elements; anode, membrane, and cathode. The anode and cathode are each contained in compartments separated from one another by the membrane. The assembly of these components constitutes a unit-cell. An electrolyzer can be made up from a number of unit-cells assembled together in a stack. If the anode of one unit-cell is connected electrically to the cathode of the adjacent unit-cell, the electrolyzer is said to be bipolar, and if all anodes are connected together electrically, and all cathodes connected similarly, the electrolyzer is said to be monopolar.

In a permselective membrane cell, it is desirable to operate with a relatively narrow gap between the two electrodes so as to minimize the voltage drop imposed by the electrical resistance of the electrolyte. The total gap is made up of an anolyte gap and a catholyte gap. The relative size of each gap is, of course, dictated by the location of the membrane.

Cationic permselective membranes of the type usually employed in chlorine/caustic soda cells, typically perfluorosulfonic acid-type membranes with equivalent weights ranging from 900 to 1200, are vulnerable, as a result of the voltage gradient, to a certain amount of back-migration of hydroxyl ions from the cathode compartment to the anode compartment. With the evolution of chlorine from the anode, this results in formation of a relatively high local concentration of alkaline hypochlorite in the immediate vicinity of the anode side of the membrane. The conductive coating used on the titanium metal anodes employed in chlorine/caustic soda membrane cells is most commonly a mixture of ruthenium and titanium oxides. Such coatings are susceptible to attack by alkaline hypochlorite, leading to rapid loss of coating with the result that the anode surface becomes non-conductive. As a consequence of this susceptibility, it is necessary to prevent the membrane from coming into direct contact with the anode. Hence, this dictates that the membrane be located close to the cathode and away from the anode. A method heretofore employed in chlorine/caustic soda membrane cells to retain the membrane in a fixed location involves a spacer or separator grid between the anode and the membrane thus preventing direct contact between anode and membrane. A similar spacer may be employed between the cathode and membrane if it is desired to prevent the membrane from coming into direct contact with the cathode.

There are two major disadvantages of this method; first, the spacer blocks a portion of the membrane, thus restricting the flow of sodium ions through the membrane and consequently increasing the voltage drop across the cell. Second, the spacer interferes with the release of gas, chlorine on the anode side and hydrogen on the cathode side, from the immediate vicinity of the electrodes, thus interfering with the flow of electrical current through the electrolyte and contributing further to an increased voltage drop across the cell.

Thus, it would be advantageous to operate a membrane cell without the presence of spacers, yet still maintain the membrane in a fixed location close to, or even in direct contact with, the cathode while preventing substantial contact of the membrane and the anode.

SUMMARY OF THE INVENTION

In accordance with this invention there is provided an improved process for the electrolysis of sodium chloride brine in an electrolytic cell wherein aqueous sodium chloride brine is introduced into the anode compartment, water or sodium hydroxide solution is introduced into the cathode compartment, the compartments being separated by a cationic permselective membrane, chlorine gas and depleted brine are withdrawn from the anode compartment through a common first conduit, and hydrogen and sodium hydroxide solution are withdrawn from the cathode compartment through a common second conduit. The improvement comprises providing a pressure differential between the anode and cathode compartments sufficient to prevent substantial contact of the membrane with the anode and reducing fluctuations in said pressure differential by maintaining free, uninterrupted flow of chlorine and depleted brine through the first conduit to a brine collection point. Additionally, the pressure differential can be further stabilized and fluctuations reduced by maintaining free, uninterrupted flow of the hydrogen and sodium hydroxide solution through the second conduit to a caustic soda collection point.

By providing a pressure differential, or pressure bias, in accordance with this invention, whereby the pressure in the anode compartment is higher than the pressure in the cathode compartment, contact of the membrane with the anode is substantially avoided. The prevention of significant fluctuations in the pressure differential not only further reduces the probability of the undesired contact but also serves to prevent weakening of the membrane by avoiding flexing of the membrane which would occur as a result of these fluctuations.

BRIEF DESCRIPTION OF THE DRAWING

The drawing is a schematic view of one unit-cell operated in accordance with this invention.

DETAILED DESCRIPTION OF THE DRAWING

It is believed that the invention will be more fully understood with reference to the accompanying drawing wherein there is shown unit-cell 10 having an anode compartment 15 containing anode 14, and a cathode compartment 17 containing cathode 16. The compartments are separated by cationic permselective membrane 12. Sodium chloride brine is introduced into the anode compartment via header 24 and line 22, and water or sodium hydroxide solution is introduced into the cathode compartment via header 20 and line 18.

Upon application of electric current through the electrodes, the sodium chloride in anode compartment 15 is dissociated resulting in the formation of chlorine gas and sodium ions. The sodium ions migrate through membrane 12 into cathode compartment 17 forming sodium hydroxide and hydrogen gas. Depleted brine anolyte and chlorine gas are withdrawn from the anode compartment through line 30 and header 32 to seal pot 42 via dip leg 44 where the liquid and gas separates, chlorine being removed via line 50 and the brine through overflow line 48. Similarly on the cathode side, sodium hydroxide catholyte and hydrogen gas are withdrawn via line 26, header 28 and dip leg 36 to seal pot 34 from whence hydrogen is removed via line 38 and catholyte via overflow line 40.

By maintaining the submergence of the anolyte dip-leg 44, designated as $S_1$, in the proper relationship to the submergence of the catholyte dip-leg 36, designated as $S_2$, it is possible to maintain the pressure in anode compartment 15 higher than the pressure in cathode compartment 17. Adjustments in the submergence of the dip-legs are accomplished by adjusting the heights of the seal leg overflows, 40 and 48. Thus, in order to maintain a constant positive pressure differential between anode and cathode compartments, it is only necessary to set the heights of the respective seal leg overflows properly. This pressure differential serves to force the flexible membrane 12 away from the anode 14 and towards the cathode 16, as shown by the drawing, and may desirably result in the membrane being held securely against the face of the cathode. This serves to prevent contact of the anode with the membrane and also to prevent flexing of the membrane.

It has been found to be important that the depleted brine and the chlorine gas leaving the anode compartment be allowed to flow freely to seal pot 42, preferably as a separated two-phase, gas-liquid flow. By this is meant that the gas and liquid should form two separate, continuous phases within the lines and headers. In order to avoid fluctuations of the internal pressures in the anode compartment, the spent brine/chlorine line must be sized and located such that the two-phases descend freely into the spent brine/chlorine header. Also, the diameter and length of the line must be such that the pressure drop contributed by the line is negligibly small compared to the total pressure. Further, line 30 should descend monotonically from the anode compartment exit to header 32 so as to avoid intermittent sealing of the line with liquid. Similarly, header 32 must have a sufficiently large cross-sectional area so that the spent brine runs freely along the bottom of the header in a stream completely separated from the flow of chlorine gas. Should the spent brine stream intermittently occupy the entire header cross-sectional area, this would result in alternate slugs of liquid and gas flowing along the header and consequent fluctuations in header pressure, which would then be transmitted back to the anode compartment as pressure fluctuations. Finally, the seal pot dip leg 44 must be of adequate diameter to maintain the separation of the gas and liquid streams. This can be conveniently assured by utilizing a dip leg similar in diameter to header 32. In order to assure a smooth flow of chlorine gas from the dip leg 44, the usual practice of employing slots or a saw-tooth configuration on the dip leg bottom may be employed.

Further stabilization of the pressure differential can be accomplished by providing for free, uninterrupted flow of the hydrogen gas and liquid catholyte in which case the requirements for the cathode side of the electrolyzer are essentially similar to those described for the anode side.

PREFERRED EMBODIMENTS

A five unit-cell bipolar electrolyzer was constructed having unit-cells similar to that shown in the drawing, employing "Nafion" membranes measuring four feet square with anodes and cathodes of corresponding size. The anodes were constructed of titanium mesh coated with titanium and ruthenium oxides and the cathodes were constructed of perforated mild steel plate. The electrode compartments were constructed of mineral fiber-filled polypropylene, the total depth of each compartment being 1½ inch. The anode of each cell was connected to the cathode of the adjacent cell with internal electrical connectors. The electrolyzer was operated at 2500–3500 amps with sodium chloride brine being fed to the anode compartments. The concentration of caustic soda produced was varied from 10 to 15 weight % by adjusting the flow of water to the cathode compartments.

The cells in this electrolyzer differed from that shown by the drawing in that the spent electrolyte/gas streams exited from the electrode compartments at the top near the center, traveled horizontally to the edge of the electrolyzer, and descended to the headers. The seal leg overflows were set to give a 1–2 " $H_2O$ positive pressure difference between anode and cathode compartments. Because of the horizontal orientation of the exit lines, there was a tendency for liquid and gas to form discreet slugs when flowing. Furthermore, the headers were of relatively small diameter (1½") so that the flowing liquid tended to occupy a large fraction of the total cross-sectional area, also resulting in intermittent flow of gas and liquid. Consequently, the internal pressures within the anode and cathode compartments, as measured by water-filled manometers connected directly to the compartments, tended to fluctuate widely, typically 4–5" $H_2O$, making it impossible to maintain a satisfactorily steady pressure difference.

Subsequently, a second electrolyzer of similar size was constructed in which the spent electrolyte exited from each electrode compartment from a port located on one side near the top, as shown by the drawing, the exit line then descending monotonically to the header, e.g., as shown by line 30 of the drawing. Because of the unrestricted flow from the electrode compartments to the headers, this electrolyzer exhibited less flucutations in the internal pressures within the anode and cathode compartments, typically 1–3" $H_2O$. However, this was still not regarded as satisfactory.

In both cases, these random pressure fluctuations would frequently act in consort so as to briefly reverse the desired 1–2" $H_2O$ positive pressure difference, thus flexing the membrane and bringing it momentarily into contact with the anode.

A third electrolyzer was constructed similarly to the prior two, but comprised sixty unit-cells instead of five and was fitted with 4" diameter headers instead of 1½". Manometers connected to individual anode and cathode compartments as well as to the headers showed that the desired positive pressure difference could be readily obtained by appropriate adjustment in the seal leg overflows and that fluctuations in pressure were negligible ($<\frac{1}{4}$" $H_2O$). In typical operation the catholyte seal pot overflow was set to give a very slight back-pressure (0–¼" $H_2O$), while the anolyte seal pot overflow was set at various heights to give back pressures ranging from 1 to 6" $H_2O$. Although the main difference between this successful operation and the earlier unsuccessful attempts was the larger header, it should be noted that the larger header, with an inside diameter of 4", has a cross-sectional area per unit-cell for the 60 cell electrolyzer of 0.21 $in^2$, while the smaller header, with an inside diameter of 1½", has a cross-sectional area per unit-cell for the 5 cell electrolyzer of 0.35 $in^2$. So it is not the cross-sectional area per unit-cell which is critical in preventing pressure fluctuations, but rather the cross-sectional area per se should be sufficient to allow separated two-phase flow.

We claim:

1. In a process for the electrolysis of sodium chloride brine wherein (a) aqueous brine is introduced into the anode compartment of an electroytic cell, (b) water or aqueous sodium hydroxide is introduced into the cathode compartment of the cell, (c) said compartments being separated by a cationic permselective membrane, (d) chlorine and depleted brine are withdrawn through a common first conduit from the anode compartment to a brine collection point and (e) sodium hydroxide solution and hydrogen are withdrawn through a common second conduit from the cathode compartment to a sodium hydroxide solution collection point, the improvement which comprises providing a pressure differential between the anode compartment and cathode compartment sufficient to prevent substantial contact between the membrane and the anode and reducing fluctuations in said pressure differential by maintaining free, uninterrupted flow of clorine and depleted brine through said first conduit and of hydrogen and sodium hydroxide solution through said second conduit.

2. A process as described in claim 1 wherein the free, uninterrupted flow of chlorine and depleted brine is maintained by providing a first conduit having an internal cross-section area sufficient to permit a separated two-phase flow of chlorine gas and liquid brine within the conduit.

3. A process as described in claim 2 wherein the free, uninterrupted flow of hydrogen and sodium hydroxide solution is maintained by providing a second conduit having an internal cross-section area sufficient to permit a separated two-phase flow of hydrogen gas and liquid solution within the conduit.

4. A process as described in claim 1 wherein there is also maintained free, uninterrupted flow of hydrogen and sodium hydroxide solution through said second conduit.

* * * * *